United States Patent [19]

Tuck

[11] 4,147,954

[45] Apr. 3, 1979

[54] THERMIONIC ELECTRON EMITTER

[75] Inventor: Richard A. Tuck, Slough, England

[73] Assignee: E M I-Varian Limited, Hayes, England

[21] Appl. No.: 813,529

[22] Filed: Jul. 7, 1977

[30] Foreign Application Priority Data

Jul. 10, 1976 [GB] United Kingdom ..... 28799/76

[51] Int. Cl.[2] ..... H01J 1/14; H01J 1/28

[52] U.S. Cl. ..... 313/337; 313/346 DC

[58] Field of Search ..... 313/337, 340, 346 DC, 313/346 R

[56] References Cited

U.S. PATENT DOCUMENTS

| | | | |
|---|---|---|---|
| 889,937 | 6/1908 | Little | 313/355 |
| 998,865 | 7/1911 | Tornberg | 313/355 X |
| 2,864,028 | 12/1958 | Coppola | 313/337 X |
| 3,434,812 | 3/1969 | Bondley | 313/346 R |
| 3,753,025 | 8/1973 | Van Stratum et al. | 313/337 X |

*Primary Examiner*—Alfred E. Smith
*Assistant Examiner*—Charles F. Roberts
*Attorney, Agent, or Firm*—Fleit & Jacobson

[57] ABSTRACT

A thermionic electron emitter comprises a tube of wall thickness less than 0.1mm, a body of thermionic electron emissive material compressed and sintered in the tube, and a ring, coaxial with the tube, within the body to provide constraint against cracking of the body.

11 Claims, 1 Drawing Figure

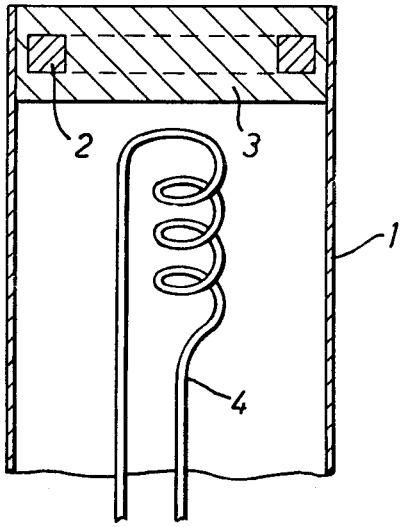
2
3
1
4

THERMIONIC ELECTRON EMITTER

This invention relates to electron emitters.

Electron emitters, such as those used as thermionic cathodes in microwave tubes, are known in which a body of material from which electrons may be efficiently emitted is held in a support of a refractory material, e.g. the metal molybdenum. Emitters of this type, sometimes called dispenser emitters, are described in U.S. Pat. No. 3,434,812. Typically, the emitter material is pressed into a matrix across the mouth of a molybdenum tube of wall-thickness large enough to withstand the pressure exerted and the tube is then machined to reduce the wall thickness other than around the matrix and thereby reduce heat loss down the tube from the matrix heated in operation.

It is an object of the invention to provide an improved electron emitter.

According to the invention there is provided a thermionic electron emitter to emit electrons when heated, including

- a tubular support having at least a thin wall portion of thickness less than 0.1mm,
- a body of thermionic electron emissive material compressed in the tubular support within the said thin wall portion, and
- a reinforcing ring, coaxial with the tube, within the body providing constraint against cracking of the body.

The support may be a tube some 0.025 mm wall thickness. The ring may be of molybdenum, the tube may be of molybdenum or an alloy thereof. The emitter may include a matrix of refractory material and be of the dispenser type.

Embodiments of the invention will now be described with reference to the drawing accompanying the Specification of an electron emitter embodying the invention and shown in a diametrical cross-section.

A tube of a refractory material such as molybdenum or 50/50 molybdenum rhenium alloy 1 is prepared. This tube has the diameter of the finished emitter, e.g. a thermionic cathode some 5–10 mm in diameter for a microwave tube. The tube is of a very thin wall less than 0.1 mm and preferably at least as thin as 0.025 mm. Such a tube is distinct from those used hitherto for such cathodes which have been some 0.15 mm in wall thickness, and reduced other than around the emitter body by selective machining after inserting the emitter material. Such a thin tube is desirable to cut down heat loss, and therefore emitter heater power, due to conduction down the tube away from the emitter material. The emitter may have a diameter in the range 3 mm upwards. Sizes in excess of 25 mm diameter are useable.

A quantity of emitter material is also prepared. This material may be that mixture conventionally used for tungsten matrix emitters or other required material. A typical mixture is a mixture of a refractory matrix material, an electron emissive material and a reducer material, e.g., by weight, 90% tungsten powder in 2 to 5$\mu$ particles, 9% stoichiometric $Ba_5 Sr (WO_6)_2$ and 1% $ZrH_2$ respectively. Other mixtures such as those known for nickel matrix based emitters may be used.

A reinforcing element in the form of a ring 2 is provided. The ring 2 is preferably molybdenum for a molybdenum tube and slightly smaller than the bore of the tube 1 so as to be an easy but preferably not too loose fit in the bore. The ring can be of round, square or other cross-section. The ring should be of material compatible with the other materials present. The ring and tube may be of the 50/50 molybdenum/rhenium alloy.

The tube 1 is supported in a press and the emitter material and ring introduced into the bore of the tube. The emitter material is pressed into the mouth of tube 1 embedding ring 2 in the body of the pressed emitter material 3 as shown in the drawing. A pressure of some 90 tons/square inch is employed to compact the material. Tube 1 has been supported in the press to prevent damage by the pressure exerted on the emitter material in forming body 3. The tube 1 containing the body 3 and ring is then removed from the press and treated as required to complete the formation of the cathode, e.g. as a matrix. This treatment is typically sintering and machining to size and form required. In use a heater is placed in tube 1 in known manner.

Hitherto when thin walled tubes have been tried the tube or emitter body has tended to crack, probably due to the stresses in the body resulting from its compaction during pressing, even when the thin tube is supported. Therefore, it has previously been necessary to use a thick-walled tube to resist these stresses and reduce the wall thickness after forming body 3 which is an expensive process and can spoil an otherwise good emitter.

The reinforcing ring permits the direct packing of thin-walled tubes and thus obviates this expensive and yield-reducing machining step, while providing a cathode with a smooth external surface which is desirable for easy assembly of the cathode in an electronic tube. Furthermore, the emission area is across the whole tube bore achieving maximum use of the space allotted for the emitter tube. Yet further, as shown in the drawing, the surface of the material 3 facing the heater is free across the whole bore of the tube.

The embedded ring has the advantage that no close tolerances are required on its size. Conveniently the ring may be parted off from standard molybdenum tubing.

The technique described above provides an improved emitter and simplifies and reduces the cost of manufacture. Such an emitter is capable of high current density and is useful for microwave tubes, including travelling wave tubes.

What I claim is:

1. A thermionic electron emitter to emit electrons when heated, including

- a tubular support having at least a thin wall portion of thickness less than 0.1mm,
- a body of thermionic electron emissive material compressed in the tubular support within the said thin wall portion, and
- a reinforcing ring, coaxial with the tube, within the body providing constraint against cracking of the body.

2. An emitter according to claim 1 in which the tubular support is of uniform wall thickness around the body and beyond the position of the body.

3. An emitter according to claim 1 in which the tubular support has a transverse dimension of at least 3 mm and not less than 25 mm.

4. An emitter according to claim 1 in which the tubular support and reinforcing element are each of a refractory material selected from the group consisting of molybdenum, tungsten, molybdenum/rhenium alloy.

5. An emitter according to claim 1 in which the electron emission material is a mixture of a refractory matrix material, an electron emissive material and a reducer material.

6. An emitter according to claim 5, wherein the electron emissive material comprises $Ba_5 Sr [WO_6]_2$.

7. An emitter according to claim 1, wherein the ring is physically separate from the tubular support.

8. An emitter according to claim 7 in which the ring is a close sliding fit in the tubular support.

9. An emitter according to claim 1, wherein the wall thickness of the support is 0.025mm or less.

10. An emitter according to claim 1, wherein the surface of the body is free to emit electrons across the whole bore of the support.

11. An emitter according to claim 10
further comprising a heating element in the tubular support, the surface of the body facing the heating element being free across the whole bore of the tubular support.

* * * * *